US009085063B2

(12) United States Patent
Esenwein

(10) Patent No.: US 9,085,063 B2
(45) Date of Patent: Jul. 21, 2015

(54) MACHINE TOOL HAVING A PROTECTIVE COVER

(75) Inventor: Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 692 days.

(21) Appl. No.: 13/388,794

(22) PCT Filed: Jun. 10, 2010

(86) PCT No.: PCT/EP2010/058123
§ 371 (c)(1),
(2), (4) Date: Apr. 11, 2012

(87) PCT Pub. No.: WO2011/018254
PCT Pub. Date: Feb. 17, 2011

(65) Prior Publication Data

US 2012/0190280 A1 Jul. 26, 2012

(30) Foreign Application Priority Data

Aug. 10, 2009 (DE) ..... 10 2009 028 404

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/05; B24B 55/052
USPC ..... 451/451–457
See application file for complete search history.

(56) References Cited

U.S. PATENT DOCUMENTS

| | | | | |
|---|---|---|---|---|
| 5,351,368 | A * | 10/1994 | Borst | 24/270 |
| 6,464,573 | B1 * | 10/2002 | Keller | 451/451 |
| 6,669,544 | B1 * | 12/2003 | Walz et al. | 451/454 |
| 7,014,547 | B2 * | 3/2006 | Kleider | 451/359 |
| 7,063,606 | B2 * | 6/2006 | Stierle et al. | 451/359 |
| 2004/0203330 | A1 | 10/2004 | Kleider | |
| 2010/0210195 | A1 * | 8/2010 | Numata et al. | 451/451 |
| 2010/0304648 | A1 * | 12/2010 | Boeck et al. | 451/451 |

FOREIGN PATENT DOCUMENTS

| | | | |
|---|---|---|---|
| CN | 2923177 | Y | 7/2007 |
| CN | 101443158 | A | 5/2009 |
| DE | 39 40 584 | A1 | 6/1991 |
| DE | 10 2007 052 684 | A1 | 5/2009 |
| DE | 10 2007 057 032 | A1 | 5/2009 |
| JP | 2000-135687 | A | 5/2000 |
| JP | 2009-54275 | A | 3/2009 |

(Continued)

OTHER PUBLICATIONS

International Search Report corresponding to PCT Application No. PCT/EP2010/058123, mailed Aug. 6, 2010 (German and English language document) (5 pages).

*Primary Examiner* — Lee D Wilson
*Assistant Examiner* — Tyrone V Hall, Jr.
(74) *Attorney, Agent, or Firm* — Maginot, Moore & Beck LLP

(57) ABSTRACT

A machine tool having a protective hood is disclosed. The machine tool has a protective cover which has a clamping joint that can be attached in a flange on the machine with a clamping device. The machine tool also includes a stop device which is configured to limit the relative rotary motion between the protective cover and the flange.

14 Claims, 6 Drawing Sheets

(56) References Cited

FOREIGN PATENT DOCUMENTS

| | | | |
|---|---|---|---|
| SU | 716792 | A1 | 2/1980 |
| SU | 1111855 | A | 9/1984 |
| WO | 2008/058796 | A1 | 5/2008 |
| WO | 2009/054275 | A1 | 4/2009 |
| WO | 2009/068341 | A1 | 6/2009 |

* cited by examiner

MACHINE TOOL HAVING A PROTECTIVE COVER

This application is a 35 U.S.C. §371 National Stage Application of PCT/EP2010/058123, filed on Jun. 10, 2010, which claims the benefit of priority to Serial No. DE 10 2009 028 404.4, filed on Aug. 10, 2009 in Germany, the disclosures of which are incorporated herein by reference in their entirety.

BACKGROUND

The disclosure relates to a power tool, in particular an angle grinder, having a protective hood covering a tool, as set forth below.

PRIOR ART

WO 2009/054275 A1 discloses a power tool having a rotating tool in the form of a grinding disk which is covered by a protective hood which is fastened to a machine-side flange. The protective hood has a clamping collar which can be put onto the flange and is fastened to the flange by means of a clamp. The protective hood can be fixed on the flange in various angular positions. To change the angular position, the clamp is slackened, whereupon the protective hood can be pivoted into the desired position. The pivoting range is restricted to a defined angular range; a stop device is provided on the power tool for this purpose, said stop device consisting of a projection on the clamp and of a counterpart on the housing of the power tool. The clamp forms together with the protective hood a common component, such that, upon rotation of the protective hood, the clamp is also rotated until the counterpart on the housing of the power tool is reached.

The one-piece configuration of clamp and protective hood constitutes a relatively complicated embodiment. In addition, this embodiment is not suitable for reliably limiting the rotation of the protective hood to a maximum permissible angle in the event of a fracture of the disk-shaped tool. On account of the relatively large mass of the protective hood, there is the risk of the hood body rotating beyond the admissible angular range due to the effect of the inertia forces, despite the stop being reached via the stop device.

SUMMARY

The object of the disclosure is to increase the safety in the event of a tool fracture on a power tool.

This object is achieved by the features of the disclosure, as set forth below. Expedient developments of the features of the disclosure are described below as well.

The power tool according to the disclosure is preferably a hand-held power tool, in particular an electric hand-held tool such as, for example, an angle grinder, the tool of which is at least partly covered by a protective hood which is provided with a clamping collar, the axis of rotation of which is coaxial to the center axis of the tool shaft. The clamping collar is, for example, cylindrical or beveled and provided with a continuous or closed or pierced or segmented lateral surface. With a clamping device, the clamping collar of the protective hood is fastened to a machine-side flange, which for this purpose has a bearing surface for the clamping collar. Via the clamping device, the clamping collar is subjected to a radial clamping force to press it against the bearing surface on the machine-side flange.

Furthermore, a stop device which limits the relative movement between the protective hood and the flange to an admissible degree is provided in the transmission path between the protective hood and the flange. According to the disclosure, the stop device comprises a stop element on the protective hood, said stop element bearing in the stop position against an associated counterpart on the flange or a component connected to the housing of the power tool. The protective hood and the clamping device are in this case embodied as separate components.

This embodiment has various advantages compared with the prior art. Firstly, the protective hood and the clamping device—as a rule a clamp—form separate components, and so the protective hood can be produced in a simpler manner, without loss of functions. The clamping device, as a separate component, acts upon the protective hood in the region of the clamping collar and presses the latter against the stop surface on the machine-side or housing-side flange of the power tool.

Furthermore, it is advantageous that the stop element is arranged directly on the protective hood, as a result of which it is firstly ensured that the stop element is at a sufficient distance from the axis of rotation through the clamping collar of the protective hood and therefore lower forces act on the stop element at a given torque. Secondly, direct force transmission is effected between the protective hood and the counterpart of the stop device without interposed components, as is the case in the prior art. On account of the direct force transmission, the risk of fracture due to the transmitted impulse when the stop is reached is reduced.

Finally, the operability of the stop device is ensured independently of the clamping device, and so, even if the clamping device fails, the protective hood can only be rotated until the stop is reached.

According to an advantageous embodiment, the protective hood, in a neutral working position, has a rotary range in the direction of rotation until the stop of the stop device is reached. The neutral working position is defined by parallel orientation of the axis of symmetry of the hood body with the armature longitudinal axis of the electric drive motor. Starting from this neutral position, there is expediently a rotary range of at most 60° in the direction of rotation of the tool.

The protective hood is therefore arranged at a distance from the stop in its neutral position, such that the stop will only become effective when the protective hood is pivoted by the admissible rotary angle. This provides for a safety reserve, since, in the event of a pronounced effect on the protective hood, the hood rotation is first of all inhibited or braked via the clamping device between clamping collar and bearing surface on the flange, such that, until the stop is reached, energy is dissipated via the friction between flange and clamping collar and accordingly the impulse upon reaching the stop is reduced.

However, it is also possible for the protective hood to be rotated together with the clamping device, energy already being dissipated during this common rotary movement on account of the friction between the clamping collar of the protective hood and the stop surface of the flange. In this case, too, the impulse upon reaching the stop is lower.

According to a further expedient embodiment, the stop element is arranged on a body of the protective hood, said body overlapping the tool of the power tool. As a rule, the hood body is configured in the shape of a circle segment, wherein the stop element advantageously projects in an angular manner on an end edge of the hood body and extends in particular in the axial direction. The stop element is expediently formed in one piece with the protective hood.

According to a further embodiment, the stop element is arranged on the clamping collar of the protective hood and is in particular embodied in one piece with the clamping collar. The stop element projects, for example, in an angular manner on the clamping collar in such a way that a section of the stop element extends parallel to the outer wall of the clamping collar in the axial direction. However, an embodiment as a stop hook on the outer wall of the clamping collar is also possible, wherein a section of the stop hook extends in the circumferential direction of the clamping collar.

On the machine or housing side, various embodiments for the counterpart are also possible, said counterpart being a component of the stop device, and the stop element which is arranged on the protective hood strikes said counterpart. Thus, according to a first advantageous embodiment, the counterpart is arranged on the clamping device which is configured to clamp the clamping collar of the protective hood in place on the flange. However, in order to ensure that, in the event of the application of a high force, the counterpart on the clamping device absorbs the impulse forces upon striking the stop element, the clamping device is advantageously locked against rotation on the flange in a positive-locking or frictional manner. This is done, for example, by screwing the clamping device to the flange or to the housing or to another machine-side component. The counterpart is formed, for example, on an actuating device which is configured to tighten the clamping device.

According to a further embodiment, the counterpart is arranged on the flange or on the housing of the power tool. In the case of an embodiment on the flange, the counterpart is configured, for example, as a component which projects beyond the lateral surface of the flange and lies in the rotary path of the stop element which is formed on the protective hood.

According to a further embodiment, the counterpart is configured as the end of an accommodating slot, into which the stop element on the protective hood projects. The stop element can be pivoted in the accommodating slot until the slot end forming the counterpart is reached.

According to yet another expedient embodiment, the stop device comprises a damping element. The damping element absorbs rotational energy of the protective hood and thereby results in a reduction in the impulse the moment the stop element strikes the counterpart. The damping element is embodied either in one piece with one of the stop partners or as a separate component which is integrated in the stop path between stop element and counterpart. In principle, suitable damping elements are spring elements, rubber elements or other components which are suitable for absorbing energy on account of their design or their material properties. For example, it is also possible to embody the damping element like a crumple zone having a deformation section which deforms elastically or plastically and thereby absorbs kinetic energy.

In a further advantageous embodiment, the flange is provided at its collar with a profiled portion, against which the inner side of the clamping collar of the protective hood bears in a positive-locking manner with a corresponding profiled portion. The advantage of this embodiment is that, if the protective hood slips, kinetic energy is already absorbed at the profiled portion before the stop is reached. In addition, a radial clamping force is generated by the tightening of the clamping device, which is placed around the clamping collar of the protective hood, said clamping collar lying sandwich-like between clamping device and flange, and this radial clamping force holds the profiled portions in the inter-engaging, positive-locking position. This enables the radial height of the profiled portion to be kept relatively small without restricting the dissipation of energy.

BRIEF DESCRIPTION OF THE DRAWINGS

Further advantages and expedient embodiments can be seen from the further claims, the description of the figures, and the drawings, in which:

In the figures, the same components are provided with the same reference numerals.

DETAILED DESCRIPTION

Figure 1:
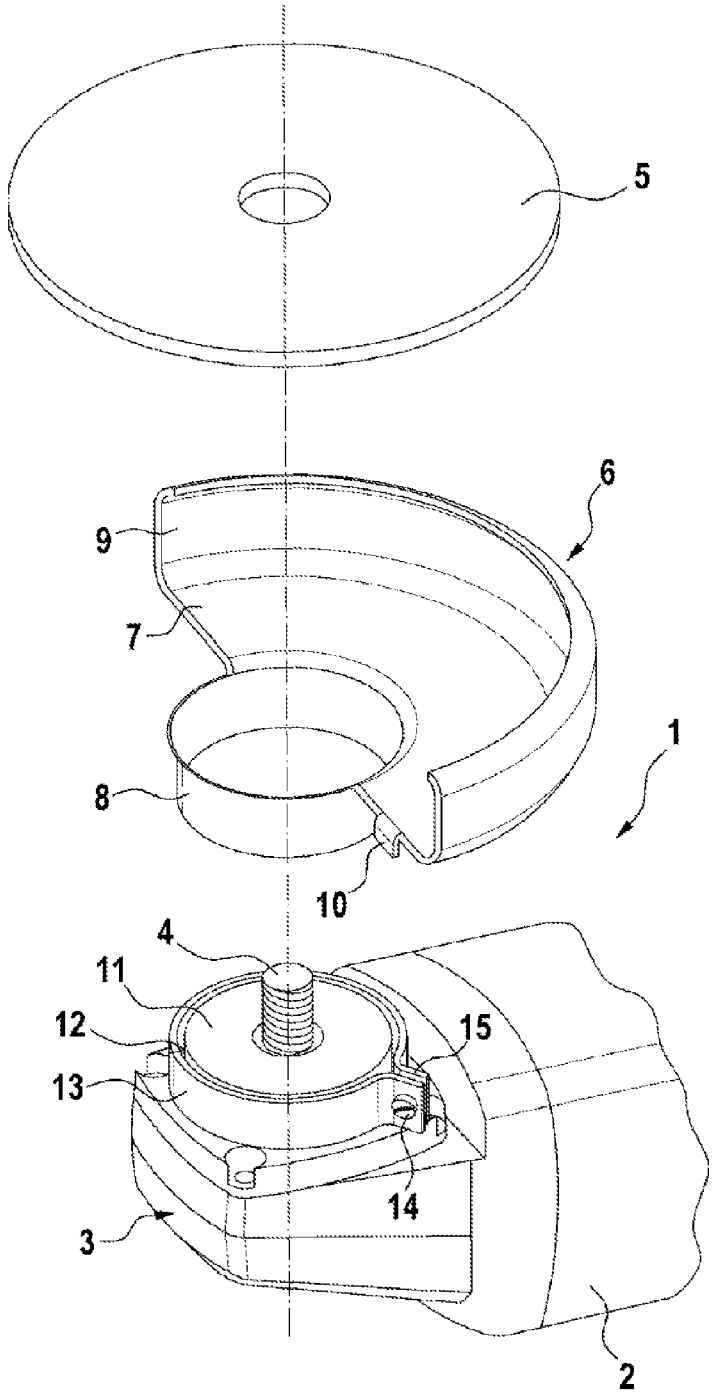
FIG. 1 shows a perspective view of a power tool designed as an angle grinder, with a grinding disk and a protective hood, in an exploded illustration.

The portable power tool shown in FIG. 1 is an angle grinder having an electric drive motor in a housing 2, wherein the drive movement of the electric drive motor is transmitted via a transmission 3 to an output shaft 4 which is disposed orthogonally to the motor shaft and with which a grinding disk 5 forming a tool can be detachably connected. The portable power tool 1 has a protective hood 6, consisting of an at least approximately semicircular hood body 7, which in the fitted position lies approximately parallel to the grinding disk 5, a clamping collar 8 and a circumferential marginal region 9 on the hood body 7. The hood body 7, the clamping collar 8 and the marginal region 9 are embodied in one piece. The protective hood 6 is detachably connected to the portable power tool 1 via the clamping collar 8.

An angular stop element 10 is integrally formed in one piece in the region of an end edge of the hood body 7; the stop element is located radially in the region between the clamping collar 8 and the radially outer marginal region 9. The stop element 10 bent at an angle extends at least approximately in the axial direction of the output shaft 4.

In the fitted position, the clamping collar 8 together with protective hood 6 is pushed onto a machine-side flange 11 having a flange neck which has a cylindrical lateral surface which forms a bearing surface 12 for the clamping collar 8. A clamp 13 is provided which is configured to fasten the protective hood 6 to the portable power tool 1. The clamp 13 is placed around the clamping collar 8 and is stressed via a screw 14, forming an actuating device, such that the clamping collar 8 is pressed with a radial clamping force against the bearing surface 12 on the flange 11 by the clamp 13.

A clamping lever configured to tighten the clamping device is also suitable as an actuating device.

The stop element on the protective hood 6 is located on the side facing away from the marginal region 9 and forms together with a section of the clamp 13 which is directed radially outward and accommodates the screw 14 a stop device configured to limit the rotation of the protective hood about the axis of the output shaft 4. In this case, the section which points radially outward and accommodates the screw 14 forms a counterpart 15 to the stop element 10; the stop device therefore consists of the stop element 10 and the counterpart 15. When the stop element 10 strikes the counterpart 15, the stop element 10 comes into contact with the head of the screw 14, and therefore the screw 14, as actuating device of the clamp, can likewise be considered in a broader sense to belong to the counterpart 15.

In the neutral working position, the stop element 10 on the protective hood 6 is at a distance from the counterpart 15 on the clamp 13. The angular distance is at most 60°. In the event of a high force acting on the protective hood 6, said protective hood 6 can rotate about the axis of the output shaft 4 on the flange 11 until the stop element 10 comes into contact with the counterpart 15 on the clamp 13. Further rotation of the protective hood relative to the flange is impossible when the stop is reached.

Figure 2:
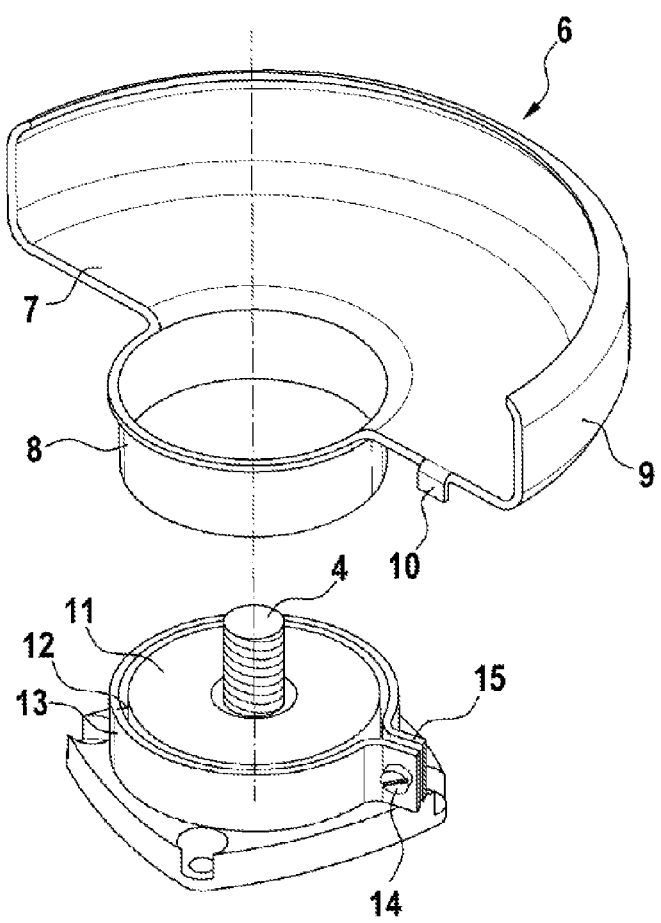
FIG. 2 shows, in a detailed illustration, a machine-side flange with a clamp and a protective hood, which can be put with its clamping collar onto the flange, a stop element being integrally formed on the body of the protective hood.

The protective hood 6 and the flange 11 are shown once again in a detailed illustration in FIG. 2. The stop element 10 at the front end edge of the hood body 7 is located radially approximately in the center between the clamping collar 8 and the outer marginal region 9. The stop element 10 extends in the axial direction to such an extent that, firstly, it can reliably bear against the counterpart 15, lying below the protective hood, on the clamp 13 and, secondly, the protective hood 7 can be pivoted without hindrance on the flange until the stop is reached in the event of an application of a high external force.

Figure 3:
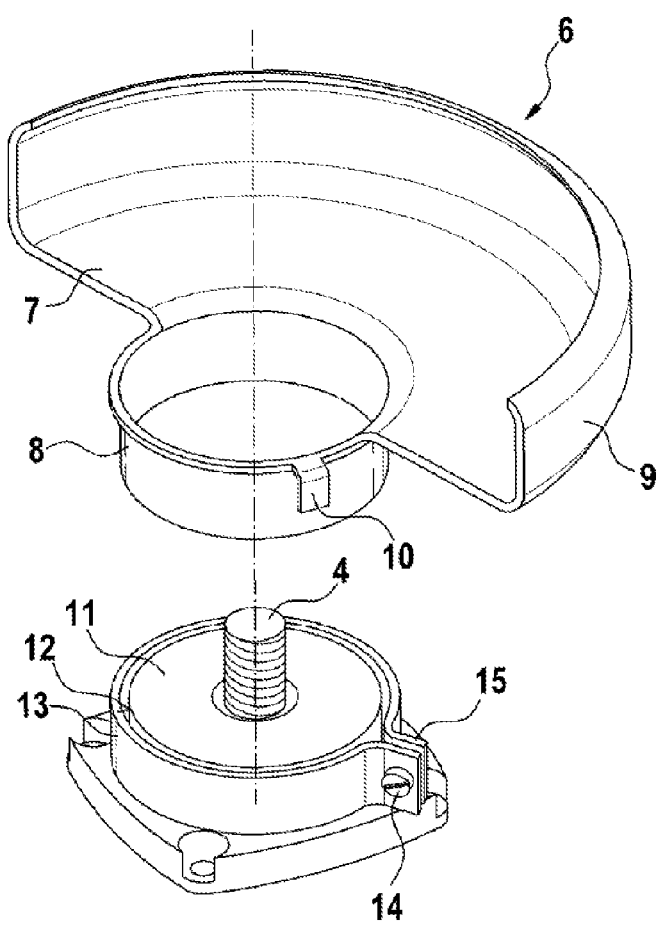
FIG. 3 shows a further exemplary embodiment, in which the stop is integrally formed on the clamping collar of the protective hood.

Shown in FIG. 3 is an embodiment variant in which the stop element is embodied in one piece with the clamping collar 8 on the protective hood 6. The stop element 10 is of angular design and is connected to the clamping collar 8 on the end face facing the marginal region 9. A section of the stop element extends from the end face in the axial direction and is at a radial distance from the outer lateral surface of the clamping collar 8.

At the flange 11, the radially projecting section of the clamp 13 interacts as counterpart 15 with the stop element 10.

Figure 4:
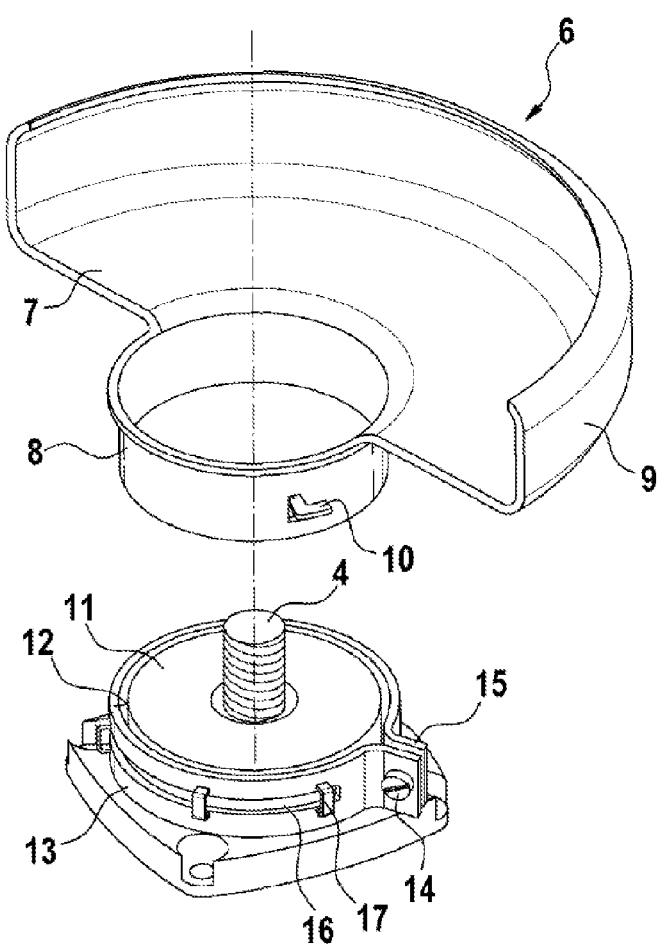
FIG. 4 shows an exemplary embodiment having a hook-shaped stop element on the clamping collar.

In the exemplary embodiment according to FIG. 4, the stop element 10 is formed in one piece with the outer wall of the clamping collar 8 on the protective hood 6. The stop element 10 forms a stop hook, wherein the free hook section is at a radial distance from the outer lateral surface of the clamping collar 8 and extends at least approximately in the circumferential direction. The stop element 10 lies coaxially at a distance from the two end faces of the clamping collar 8.

The counterpart to the stop element 10 forms a clamp slot 16 which is made in the clamp 13 and extends in the circumferential direction. The stop is formed by the end of the clamp slot, in which the stop element 10 is guided. For stabilizing the clamp 13, which is split by the clamp slot, braces 17 are provided which extend in the axial direction and overlap the clamp slot 16. The braces 17 are curved in order to allow the stop element 10 to slide along in the clamp slot 16 without collisions.

If need be, the clamp slot 16 narrows toward the slot end in order to brake the movement of the protective hood before reaching the slot end. The stop element 10 guided in the clamp slot is subjected to a clamping force as a result of the narrowing clamp slot, and this clamping force produces the braking action.

Braking during a relative rotary movement of the protective hood 6 about the axis of the output shaft 4 can also be achieved by the clamp slot 16 not being at a constant distance from the base of the flange 11 but rather by said clamp slot 16 reducing the axial distance from the flange base toward the slot end, such that, with increasing rotation of the protective hood 6, the bottom end face of the clamping collar 8 rests on the flange base and is braked there on account of the frictional force produced. Braking can also be achieved by a change in the radial distance of the clamp slot from the bearing surface of the flange.

Figure 5:
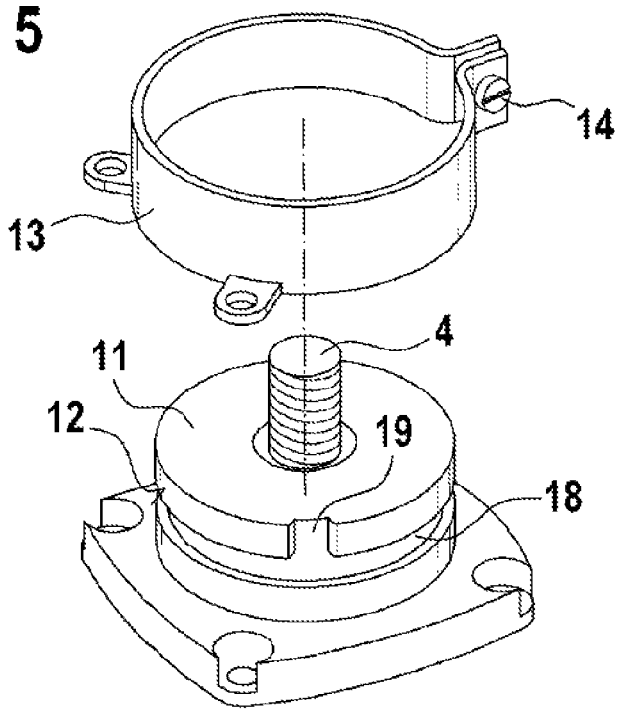
FIG. 5 shows the machine-side flange including a clamp in a further embodiment.

A further exemplary embodiment is shown in FIG. 5. The clamp 13 is embodied in a conventional manner and is fastened at its radially projecting collar to the bearing surface 12 of the flange 11 via the screw 14. The protective hood is guided via a flange slot 18 which is made in the flange 11 in the region of the bearing surface 12. Located in the top section of the flange 11 is an axially running insertion opening 19 which extends from the top end face of the flange to the flange slot 18.

On the protective hood, a stop element directed radially inward, for example a pin, is formed on the inner side of the clamping collar, said pin, during the fitting, being pushed axially via the insertion opening 19 onto the flange 11 until the flange slot 18 is reached. Upon rotation of the protective hood 6, the pin slides along in the flange slot 18 and moves away from the axial insertion opening 19, as a result of which axial locking is achieved. The rotary movement of the protective hood is limited via stops in the flange slot 18, in particular by the end of the flange slot 18.

Figure 6:
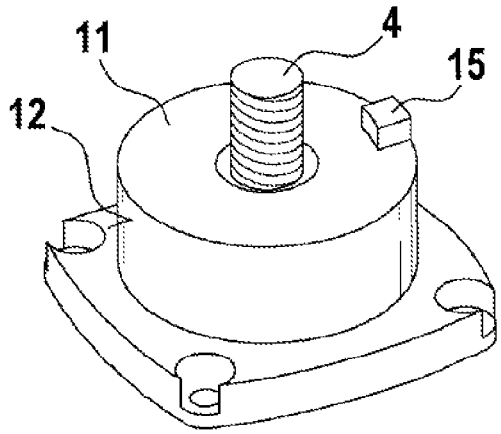
FIG. 6 shows a detail of the machine-side flange with counterpart arranged thereon.

In the exemplary embodiment according to FIG. 6, an element 15 as counterpart to the stop element on the protective hood is arranged on the axial end face of the flange 11 within the radius of the bearing surface 12. The associated stop element on the protective hood is expediently located on the inner side of the protective hood.

Figure 7:
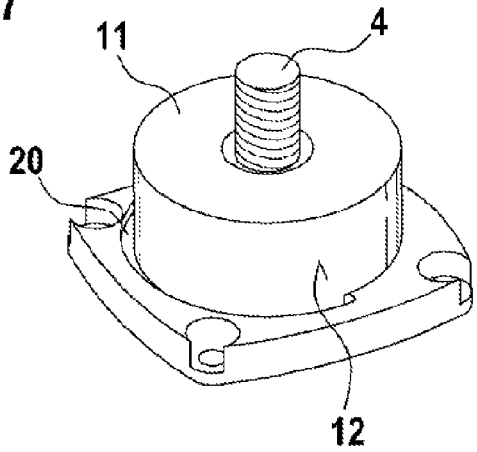
FIG. 7 shows a further embodiment of a flange having an accommodating slot incorporated at the base of the flange for accommodating a stop element on the protective hood.

In the exemplary embodiment according to FIG. 7, a slot 20 is made in the base region of the flange 11, an axially projecting stop element on the protective hood, in particular on the end face of the clamping collar, projecting into said slot 20 in the fitted position. Upon rotation of the protective hood, the stop element can travel along in the slot 20 until the slot end is reached, said slot end forming the counterpart.

Figure 8:
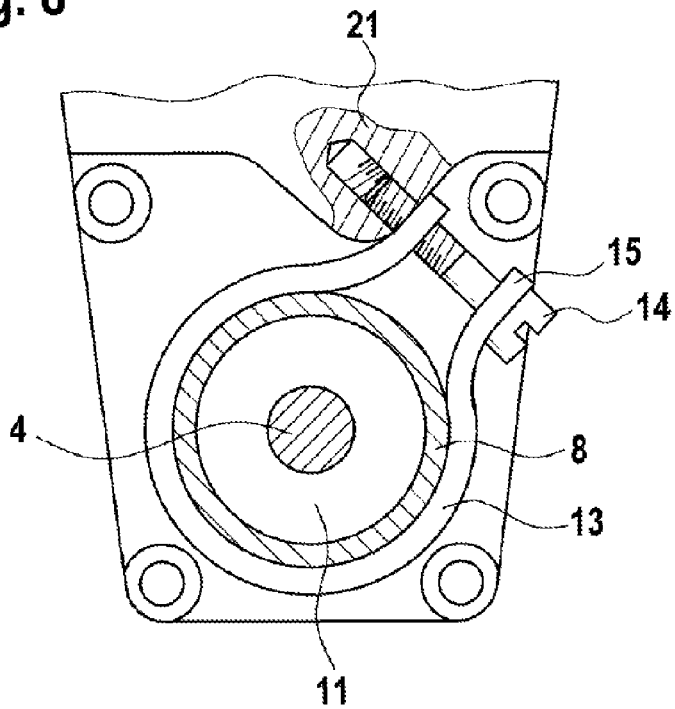
FIG. 8 shows an illustration of a clamp screwed to the transmission housing of the power tool.

In the exemplary embodiment according to FIG. 8, the radially projecting collar of the clamp 13 or the actuating device embodied as a screw 14 configured to tighten the clamp forms the counterpart 15 to the stop element on the protective hood. The screw 14 is screwed to the transmission housing 21 of the power tool, such that the clamp 13 is immovably secured to the housing of the power tool and a relative rotation of the clamp about the bearing surface of the flange is impossible even during the application of a high force in the event of the protective hood pivoting.

What is claimed is:

1. A power tool, comprising:

a housing;

a protective hood which at least partly covers a tool and has a clamping collar;

a machine-side flange, which has a bearing surface for the clamping collar;

a clamping device, which fastens the clamping collar to the flange, wherein the clamping collar is subjected to a clamping force via the clamping device to press it against the bearing surface on the flange; and a stop device limiting a relative movement between the protective hood and the flange, wherein:

the stop device is arranged between the protective hood and the flange; and the stop device includes:

a stop element on the protective hood, and an associated counterpart arranged on the clamping device; and when in a stop position, said stop element presses against the counterpart to form a stop;

wherein the protective hood and the clamping device are separate components.

2. The power tool as claimed in claim 1, wherein, when in a neutral working position, the protective hood is able to rotate in a direction of rotation until the stop element reaches the counterpart.

3. The power tool as claimed in claim 1, wherein the stop element is arranged on a hood body overlapping a tool of the power tool.

4. The power tool as claimed in claim 3, wherein the hood body is configured in the shape of a circle segment and the stop element projects in an angular manner from an end edge of the hood body.

5. The power tool as claimed in claim 1, wherein the stop element is arranged on the clamping collar of the protective hood.

6. The power tool as claimed in claim 5, wherein the stop element-projects in an angular manner from the clamping collar and a section of the stop element extends parallel to an outer wall of the clamping collar.

7. The power tool as claimed in claim 5, wherein the stop element is arranged as a stop hook on an outer wall of the clamping collar, and a section of the stop hook extends in a circumferential direction of the clamping collar.

8. The power tool as claimed in claim 1, wherein an actuating device on the clamping device is configured to tighten the clamping device, wherein the actuating device forms the counterpart of the stop device.

9. The power tool as claimed in claim 1, wherein the counterpart is configured as a component which projects beyond a lateral surface of the flange.

10. The power tool as claimed in claim 1, wherein the counterpart is-configured as an end of an accommodating slot, into which the stop element on the protective hood projects.

11. The power tool as claimed in claim 1, wherein the stop device further comprises a damping element.

12. The power tool as claimed in claim 11, wherein the damping element is formed in one piece with the stop element on the protective hood and/or the counterpart.

13. The power tool as claimed in claim 1, wherein the clamping device is locked against rotation on the flange in a positive-locking or frictional manner.

14. The power tool as claimed in claim 1, wherein the protective hood is arranged to be rotatable relative to the clamping device.

* * * * *